US006808388B2

(12) United States Patent
Lee

(10) Patent No.: US 6,808,388 B2
(45) Date of Patent: Oct. 26, 2004

(54) NOVELTY CANDLEHOLDER

(75) Inventor: Seungsoo Lee, Monroe Township, NJ (US)

(73) Assignee: Joy World, Inc., Monroe, NJ (US)

( * ) Notice: Subject to any disclaimer, the term of this patent is extended or adjusted under 35 U.S.C. 154(b) by 45 days.

(21) Appl. No.: 10/422,148

(22) Filed: Apr. 24, 2003

(65) Prior Publication Data

US 2003/0203332 A1 Oct. 30, 2003

Related U.S. Application Data

(60) Provisional application No. 60/375,329, filed on Apr. 25, 2002.

(51) Int. Cl.[7] ..... F23D 1/00

(52) U.S. Cl. ..... 431/253; 431/288; 431/296

(58) Field of Search ..... 431/296, 253, 431/125, 288; 362/86, 342, 802, 810; 369/30.02

(56) References Cited

U.S. PATENT DOCUMENTS 3,994,502 A * 11/1976 Lombardi ..... 369/30.02
4,801,478 A * 1/1989 Greenblatt ..... 428/1.1
5,015,175 A 5/1991 Lee
5,174,645 A * 12/1992 Chung ..... 362/86
5,363,590 A 11/1994 Lee
5,487,658 A 1/1996 Lee
5,622,490 A * 4/1997 Cheng ..... 431/288

* cited by examiner

*Primary Examiner*—James C. Yeung
(74) *Attorney, Agent, or Firm*—McCarter & English, LLP; John K. Kim

(57) ABSTRACT

A device for supporting a candle thereon includes a casing having an opening therein and a generating mechanism for generating special effects, such as audible sounds. More particularly, the generating mechanism includes a switch mounted in the opening of the casing. The switch has a first contact member, which is substantially immovable relative to the casing, and a second contact member. The second contact member is movable relative to the first contact member between a first position, in which the second contact member is in contact with the first contact member, and a second position, in which the second contact member is out of contact with the first contact member. The generating mechanism is adapted to generate special effects when the second contact member is in its first position. A movable member is movably mounted on the casing for moving the second contact member between its first and second positions.

27 Claims, 8 Drawing Sheets

NOVELTY CANDLEHOLDER

CROSS-REFERENCE TO RELATED APPLICATION

This is a non-provisional application relating to U.S. Provisional Patent Application No. 60/375,329 filed Apr. 25, 2002.

FIELD OF THE INVENTION

The present invention relates to candleholders and, more particularly, to a candleholder adapted to generate special effects, such as audible sounds.

BACKGROUND OF THE INVENTION

Candle assemblies adapted to generate audible sounds (e.g., musical melodies) have been developed for enhancing amusement at birthday parties, gatherings, etc. For instance, U.S. Pat. Nos. 5,015,175, 5,363,590 and 5,487,658 disclose a sound-producing candle assembly having a thermo-responsive member extending through a candle. The thermo-responsive member is adapted to activate an associated electronic unit so as to generate audible sounds when the candle is lit. Because the thermo-responsive member is incorporated directly into the candle, the production of the candle assembly is rendered costly.

FIGS. 1–4 illustrate another type of sound-generating candle assembly 10. More particularly, the candle assembly 10 includes a candleholder casing 12 for housing an electronic unit 14 therein. The electronic unit 14 includes a printed circuit board 16, a speaker 18 and a pair of wire-like contacts 20, 22 mounted to an upper end 24 of the casing 12. A metallic ring 26 is rotatably mounted to the upper end 24 of the casing 12. The ring 26 has an upper portion 28 for receiving a lower end 30 of a candle 32 and a lower portion 34 for receiving the upper end 24 of the casing 12. The lower portion 34 of the ring 26 has a protruding section 36 such that, when the ring 26 is positioned in an "off" position, the contact 20 is out of engagement with the ring 26 (see FIG. 3) and such that, when the ring 26 is positioned in an "on" position, the contact 20 is in engagement with the ring 26 (see FIG. 4). The other contact 22 is in constant engagement with the ring 26 during the movement of the ring 26 between its "on" and "off" positions. In this manner, when the ring 26 is in its "on" position, both of the contacts 20, 22 are in engagement with the ring 26, and an associated switch circuit of the electronic unit 14 is closed by the ring 26, causing the electronic unit 14 to generate audible sounds. When the ring 26 is placed in its "off" position, the contact 20 is out of engagement with the ring 26, causing the switch circuit to be open and hence deactivating the electronic unit 14.

While the switch device of the candle assembly 10 shown in FIGS. 1–4 is relatively inexpensive, it suffers from various shortcomings. For instance, because the ring 26 is placed over the upper end 24 of the casing 12 by way of a friction fit, it can come off easily from the casing 12. Moreover, due to the irregular shape of the protruding section 36 of the ring 26, the engagement between the contact 20 and the ring 26 is imprecise, potentially causing improper operation of the electronic unit 14. In the foregoing circumstances, there is a need for a candleholder having an improved switch mechanism for enhancing its operation.

SUMMARY OF THE INVENTION

The present invention overcomes the disadvantages and shortcomings discussed above by providing an improved device adapted to support a candle thereon. The device includes a casing having an opening therein and a generating mechanism for generating special effects, such as audible sounds. More particularly, the generating mechanism includes a switch mounted in the opening of the casing. The switch has a first contact member, which is substantially immovable relative to the casing, and a second contact member. The second contact member is movable relative to the first contact member between a first position, in which the second contact member is in contact with the first contact member, and a second position, in which the second contact member is out of contact with the first contact member. The generating mechanism is adapted to generate special effects when the second contact member is in its first position. A movable member is movably mounted on the casing for moving the second contact member between its first and second positions.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE INVENTION

Figure 1:
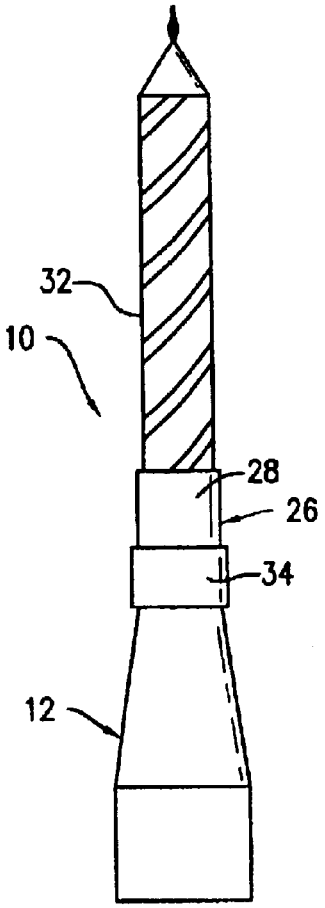
(PRIOR ART) FIG. 1
FIG. 1 is a side elevational view of a conventional candle assembly adapted to generate audible sounds.
Figure 3:
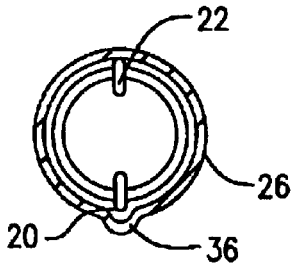
(PRIOR ART) FIG. 3
FIGS. 3 and 4 are schematic views of a switch device utilized in the candle assembly shown in FIGS. 1 and 2.
Figure 4:
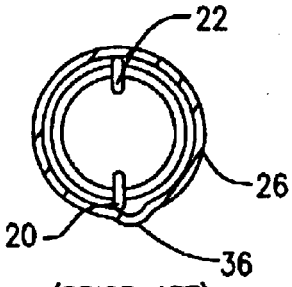
(PRIOR ART) FIG. 4
Figure 2:
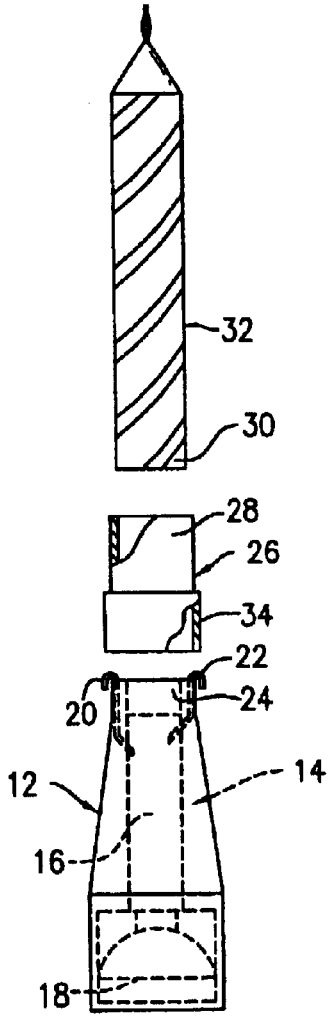
(PRIOR ART) FIG. 2
FIG. 2 is an exploded view of the candle assembly shown in FIG. 1.
Figure 5:
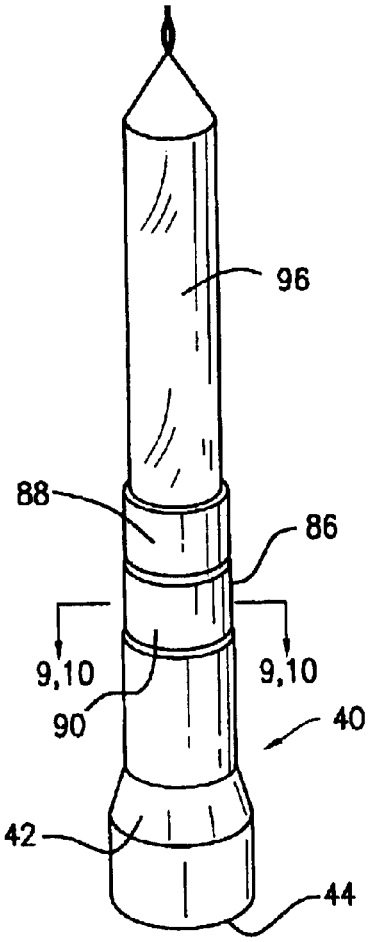
FIG. 5 is a perspective view of a candle assembly constructed in accordance with a first embodiment of the present invention.
Figure 6:
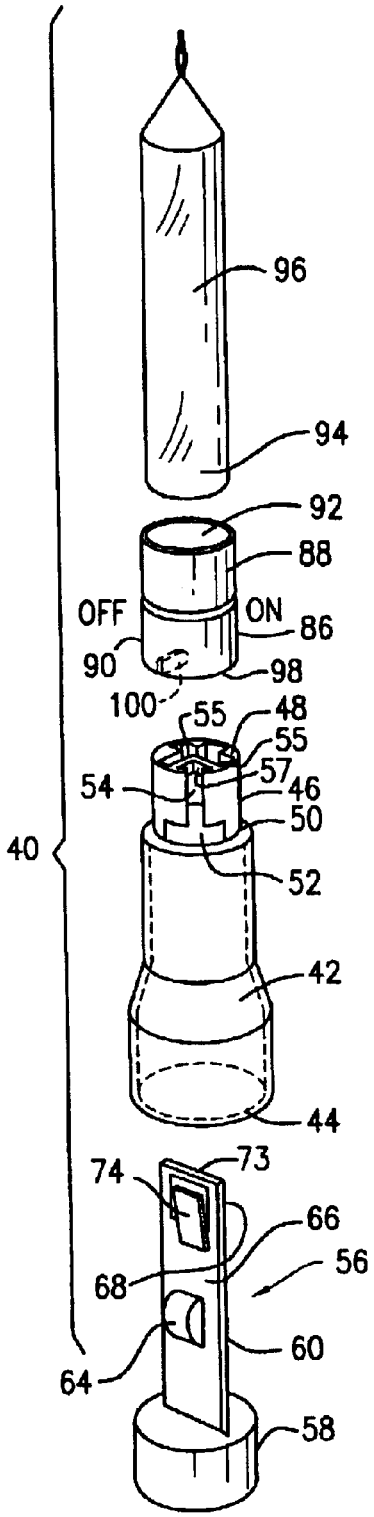
FIG. 6 is an exploded perspective view of the candle assembly shown in FIG. 5.

Referring to FIGS. 5 and 6, there is shown a candleholder 40 constructed in accordance with a first embodiment of the present invention. More particularly, the candleholder 40 includes a casing 42 having an open lower end 44. The casing 42 is also provided with a cylindrically shaped upper portion 46 having an open top end 48 and a bottom end 50.

A horizontal slot 52 extends in a horizontal direction along the bottom end 50, while a vertical slot 54 extends in a vertical direction between the top end 48 and the horizontal slot 52. The top end 48 is also provided with tracks 55 and a support member 57 projecting in a substantially radial direction for purposes to be discussed herinafter.

Figure 8:
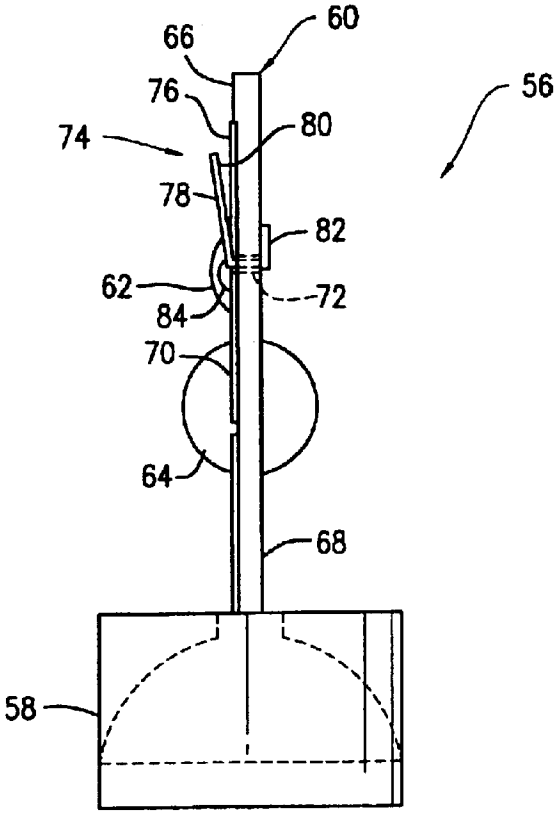
FIG. 8 is a side elevational view of the circuit unit shown in FIG. 7.
Figure 7:
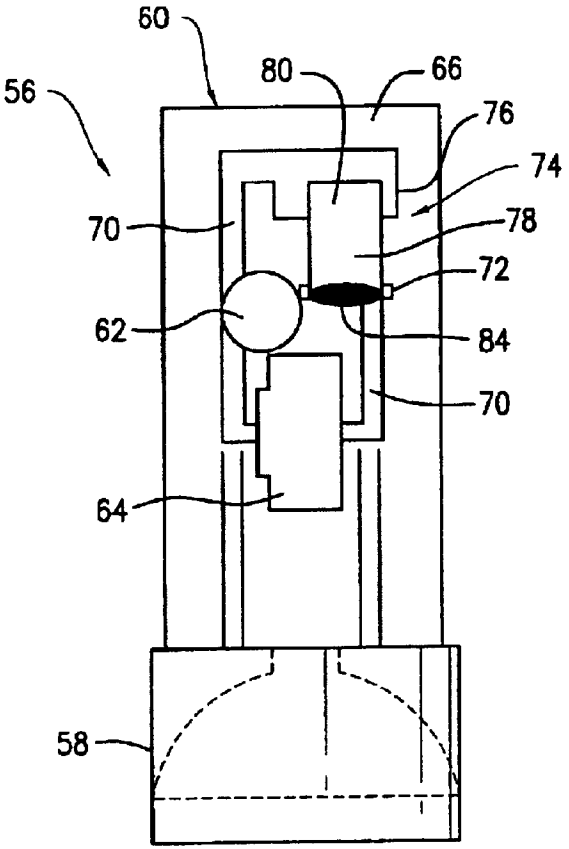
FIG. 7 is a front elevational view of an electronic circuit unit utilized in the candle assembly shown in FIGS. 5 and 6.

With reference to FIGS. 6–8, the candleholder 40 also includes an electronic circuit unit or assembly 56. The circuit unit 56 includes various conventional electrical/electronic components. For instance, the circuit unit 56 includes a speaker unit 58, a printed circuit board 60, a preprogrammed chip 62 and a power source 64 (e.g., a battery). These components are electrically connected in a conventional manner so as to produce audible sounds and/or other special effects upon activation of the circuit unit 56. In such circumstances, the circuit unit 56 can be equipped with any conventional circuitry adapted for generating audible sounds and/or other special effects, such as the one disclosed in U.S. Pat. No. 5,015,175 or 5,487,658.

Still referring to FIGS. 6–8, the circuit unit 56 is mounted within the casing 42 by inserting same through the open lower end 44 of the casing 42. In this regard, the speaker unit 58 closes off the open lower end 44 of the casing 42 once the circuit unit 56 is mounted in the casing 42. The printed circuit board 60, which extends from the speaker unit 58 and which includes a front side 66 and a rear side 68, has a conventional printed circuit 70 on the front side 66. The printed circuit board 60 also includes a slit 72 formed therethrough for purposes to be discussed hereinafter. The tracks 55 (see FIG. 6) of the top end 48 of the casing 42 receives an upper end 73 of the printed circuit board 60 for securing same in the casing 42.

With reference to FIGS. 7 and 8, the printed circuit board 60 includes a switch 74 mounted on the printed circuit board 60 for activating the circuit unit 56 when the switch 74 is in its electrically closed condition. More particularly, the switch 74 includes an expanded contact area 76 formed on the front side 66 of the printed circuit board 60 as part of the printed circuit 70. Alternatively, the contact area 76 can be formed as a component separate from the printed circuit 70. The switch 74 also includes a switch plate 78 mounted on the printed circuit board 60 for engagement with the contact area 76. The switch plate 78 includes a contact portion 80 and a mounting end 82. The mounting end 82 is inserted through the slit 72 from the front side 66 of the printed circuit board 60 and is bent such that the mounting end 82 is located on the rear side 68. The contact portion 80 is located on the front side 66 of the printed circuit board 60 and is normally slanted from the printed circuit board 60 so as to be disengaged from the contact area 76. A solder ball 84 affixes the contact portion 80 in its slanted orientation and connects the switch plate 78 to the printed circuit 70. The contact portion 80 is provided with a sufficient elasticity such that it is movable between a closed position, in which it is in contact with the contact area 76 so as to define an electrically closed condition of the switch 74, and an open position, in which it is in its slanted orientation (i.e., it is disengaged from the contact area 76) so as to define an electrically open condition of the switch 74. The switch plate 78 is positioned within the casing 42 such that it is substantially aligned with the horizontal slot 52 of the casing 42 for purposes to be discussed hereinafter.

A ring 86 (see FIGS. 5 and 6) is rotatably mounted to the upper portion 46 of the casing 42 and includes an upper section 88 and a lower section 90. The upper section 88 includes an opening 92 for receiving a bottom end 94 of a candle 96 such that the candle 96 can be supported on the casing 42. In this regard, the support member 57 (see FIG. 6) of the casing 42 prevents the bottom end 94 of the candle 96 from protruding into the casing 42 when the candle 96 is inserted into the ring 86.

With reference to FIG. 6, the lower section 90 of the ring 86 has an opening 98 receiving the upper portion 46 of the casing 42. The lower section 90 is also provided with a finger 100 extending radially inwardly into the opening 98. The finger 100 is movably positioned in the horizontal slot 52 of the casing 42 so as to permit rotation of the ring 86 relative to the casing 42. In this regard, the vertical slot 54 permits the mounting of the ring 86 onto the upper portion 46 of the casing 42. More particularly, the ring 86 is mounted onto the casing 42 by inserting the finger 100 into the vertical slot 54 and then placing same in the horizontal slot 52. Once the finger 100 is placed in the horizontal slot 52, the ring 86 is rotated so as to misalign the finger 100 relative to the vertical slot 54, thereby inhibiting the ring 86 from being removed inadvertently from the casing 42. The finger 100 is adapted to engage the switch plate 78, as will be discussed in greater detail hereinbelow.

Figure 9:
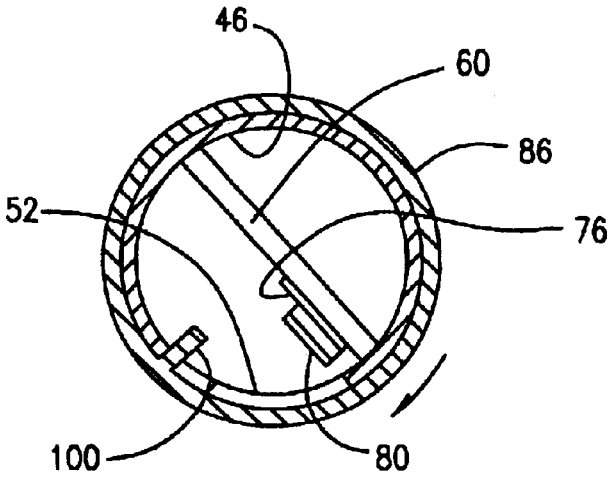
FIGS. 9 and 10 are schematic views of a switch device utilized in the candle assembly shown in FIGS. 5 and 6.
Figure 10:
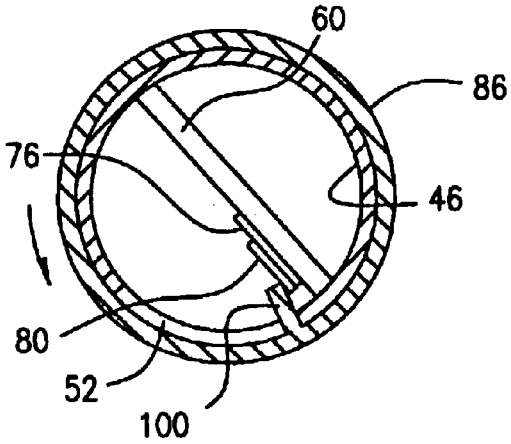

In order to activate the circuit unit 56, the ring 86 is rotated in a predetermined direction (e.g., a counterclockwise direction) to an "on" position such that the finger 100 comes in contact with the contact portion 80 of the switch plate 78 and urges same against the contact area 76, thereby positioning the contact portion 80 in its closed position (see FIG. 10). As a result, an associated switch circuit of the circuit unit 56 connected to the switch 74 is closed, causing the circuit unit 56 to generate audible sounds. Due to the friction fit between the ring 86 and the casing 42, the ring 86 is maintained in its "on" position. When the ring 86 is rotated in an opposite direction to an "off" position (see FIG. 9), the finger 100 is disengaged from the contact portion 80, causing same to move to its open position and hence deactivating the circuit unit 56. As a result, the circuit unit 56 terminates the production of audible sounds.

It should be appreciated that the present invention provide numerous advantages over the prior art discussed above. For instance, the ring 86 can be removed from the casing 42 only when the finger 100 is aligned with the vertical slot 54. Because the vertical slot 54 is hidden by the ring 86, it is difficult for a user to detach the ring 86 from the casing 42. In such circumstances, the ring 86 is inhibited from being accidentally disconnected from the casing 42. Moreover, the contact area 76 and the switch plate 78 provide a precise electrical connection, minimizing malfunctioning of the candleholder 40.

Figure 11:
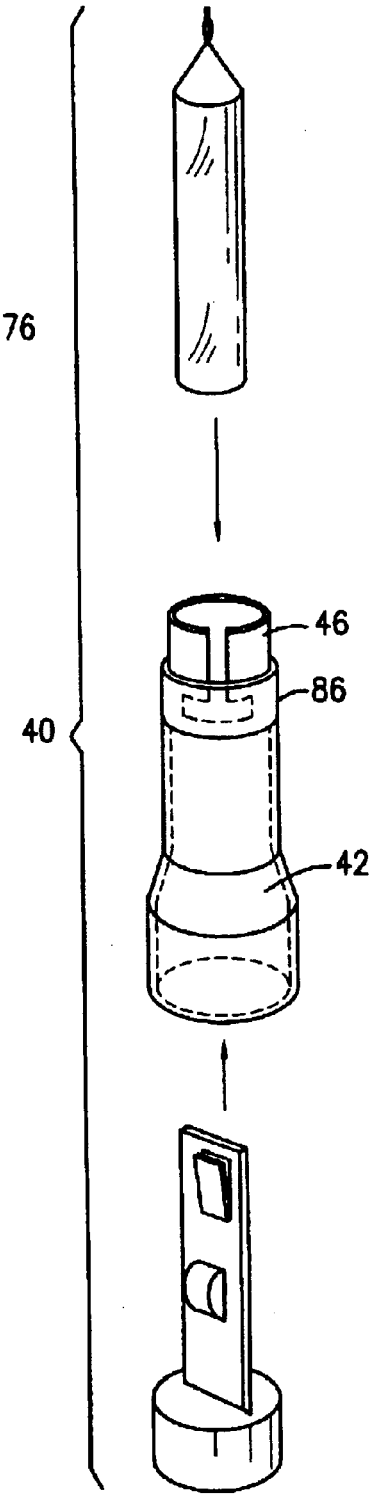
FIG. 11 is an exploded perspective view of a modified version of the candle assembly shown in FIGS. 5–10.

It should be noted that the present invention can have numerous modifications and variations. For instance, the vertical slot 54 can be completely eliminated. In such circumstances, the finger 100 is directly placed into the horizontal slot 52. Moreover, the ring 86 can be made from any suitable materials, such as plastic, metal, non-metal, etc. The ring 86 can also be replaced with other mechanisms, such as a sector-shaped member or an open looped member. In addition, the candleholder 40 can be adapted to generate other types of special effects, such as visual effects (e.g., visible lights, etc.). Further, the upper section 88 of the ring 86 can be eliminated (see FIG. 11). In such circumstances, the upper portion 46 of the casing 42 can extend above the ring 86 for mounting the candle 96 thereon. The ring 86 can also be used as a safety device, as disclosed in U.S. Pat. Nos. 5,363,590 and 5,487,658.

FIGS. 12–16 depict a second embodiment of the present invention. Elements illustrated in FIGS. 12–16, which correspond, either identically or substantially, to the elements described above with respect to the embodiment of FIGS. 5–11, have been designated by corresponding reference numerals increased by one thousand. Unless otherwise stated, the embodiment of FIGS. 12–16 is constructed and assembled and operates in the same basic manner as the embodiment of FIGS. 5–11.

Figure 12:
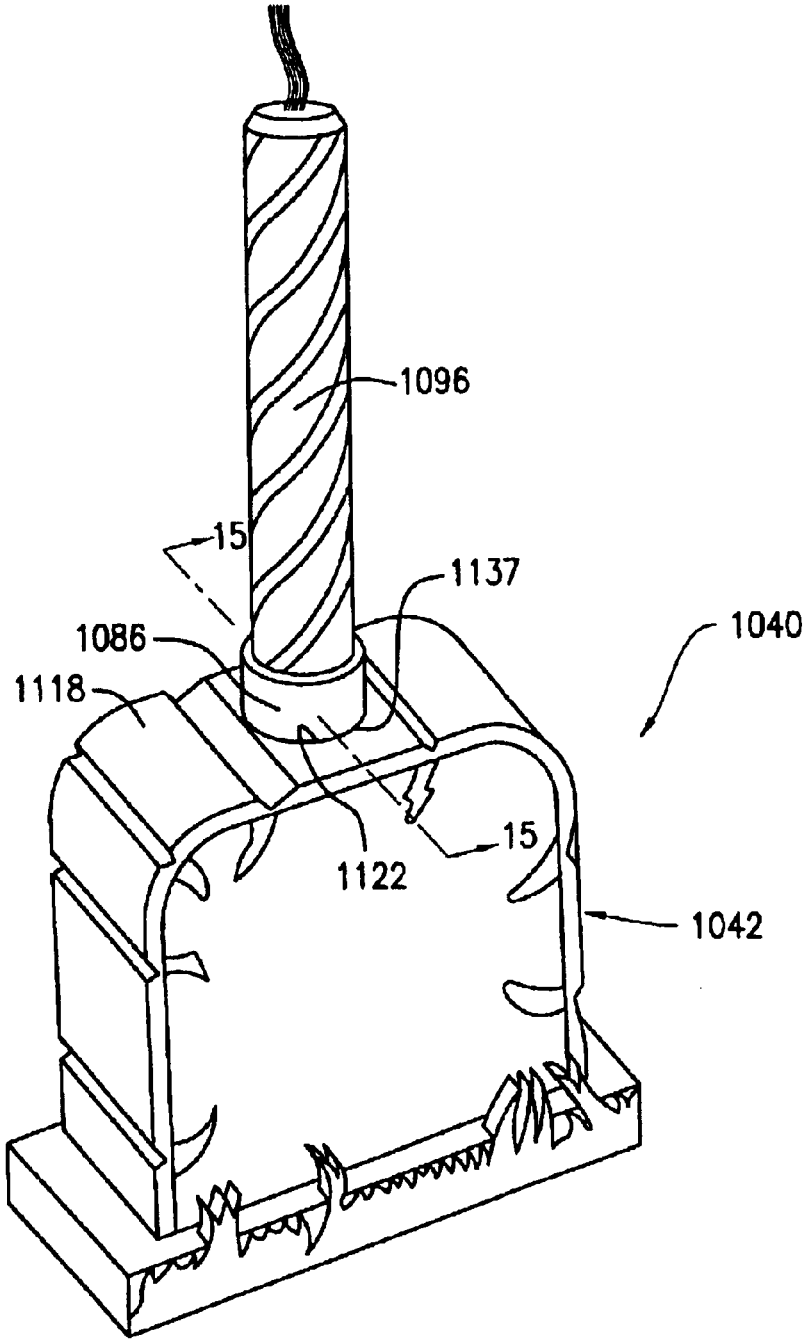
FIG. 12 is a front perspective view of a candle assembly constructed in accordance with a second embodiment of the present invention.
Figure 13:
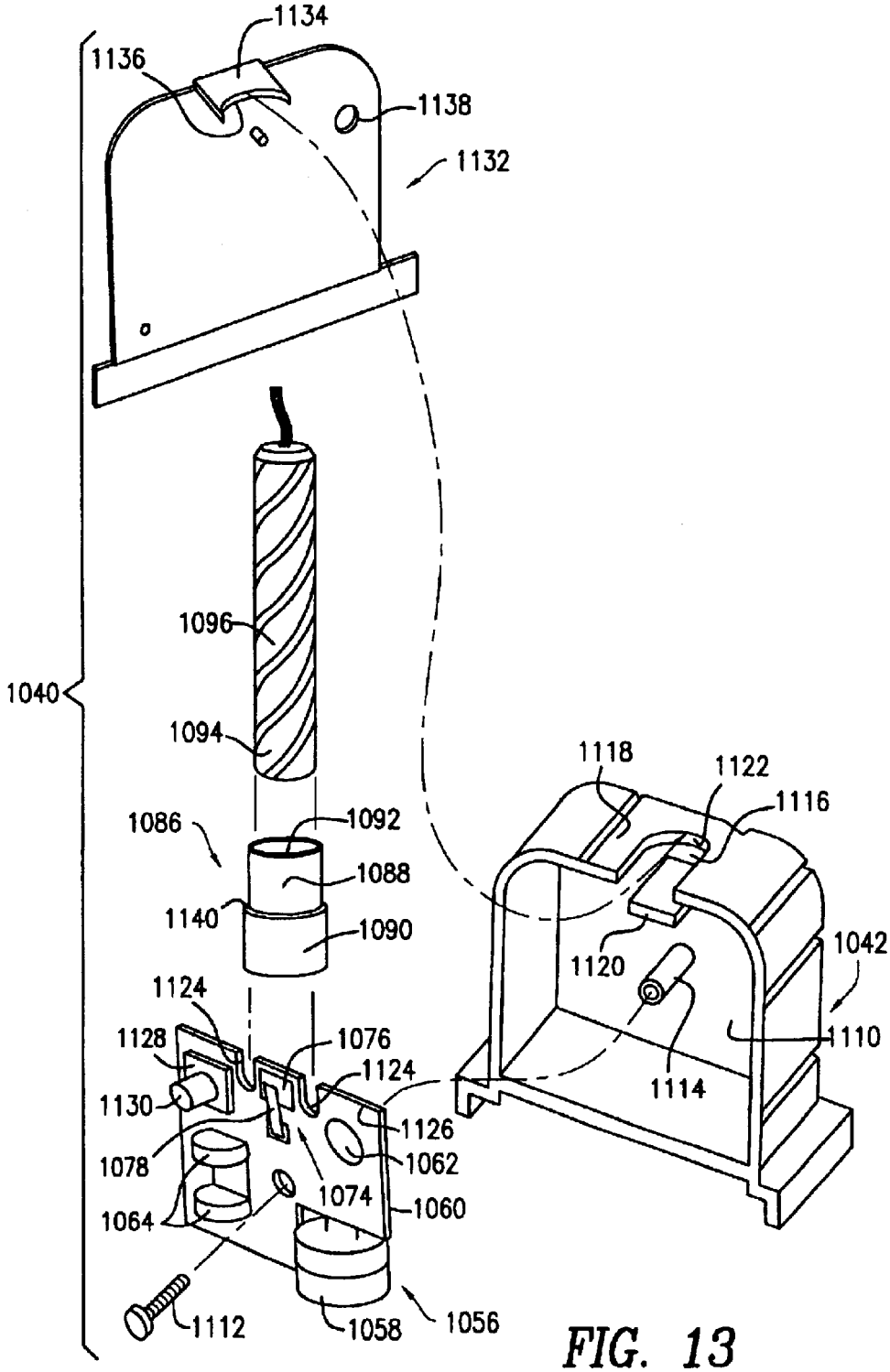
FIG. 13 is an exploded perspective view of the candle assembly shown in FIG. 12.
Figure 14:
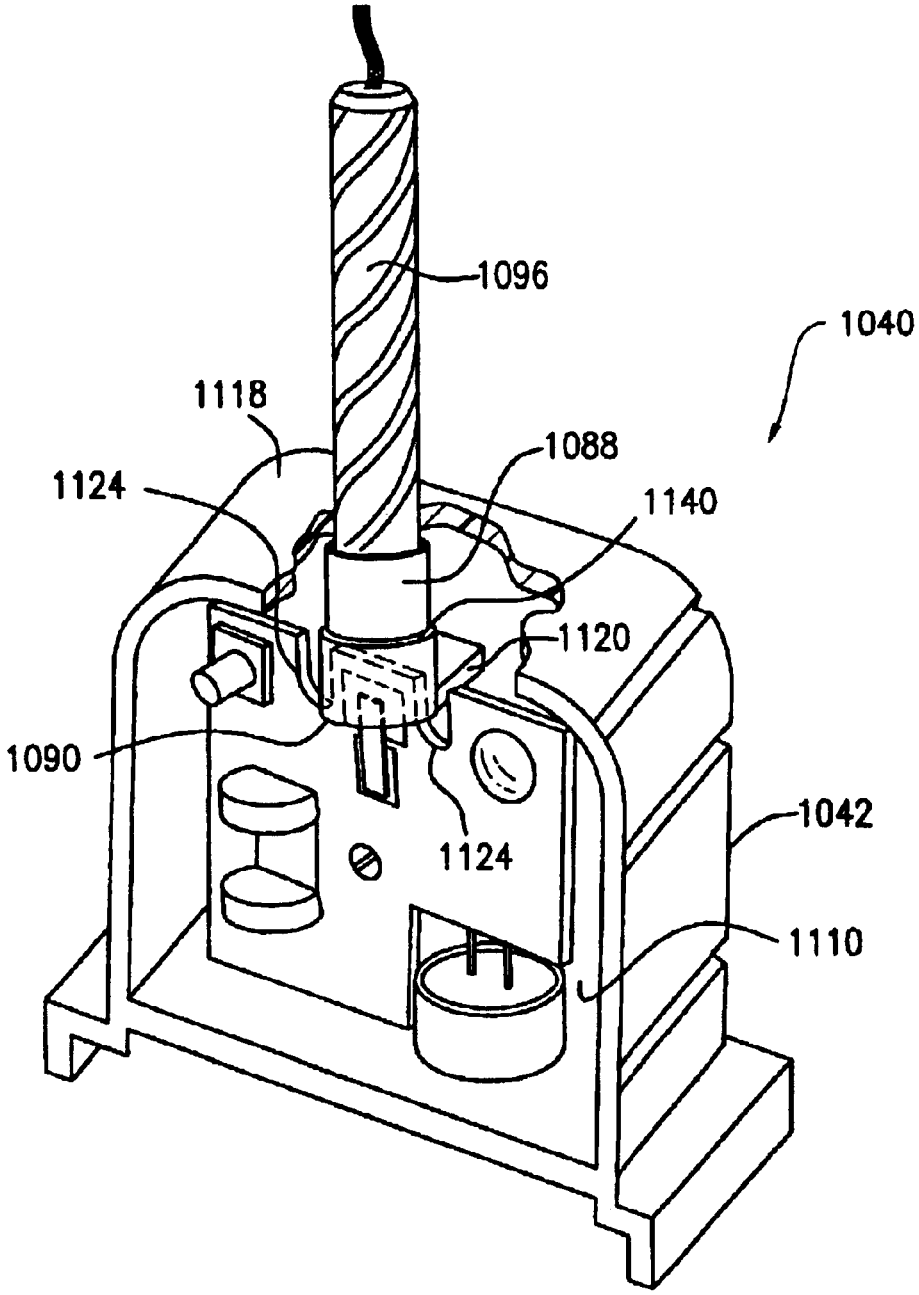
FIG. 14 is a rear perspective view of the candle assembly shown in FIG. 12 without its rear cover.

With reference to FIGS. 12–14, there is shown a candleholder 1040 constructed in accordance with a second embodiment of the present invention. More particularly, the candleholder 1040 includes a casing 1042 and an electronic circuit unit or assembly 1056. The casing 1042 has a substantially rectangular shape and includes an opening 1110 (see FIG. 13) therein for receiving the circuit unit 1056. The circuit unit 1056 is securely mounted in the opening 1110 via a screw 1112 which is threaded into a threaded column 1114 projecting from the casing 1042 (see FIG. 13). A hole 1116 is formed in an upper side or wall 1118 of the casing 1042, while a ledge 1120 projects from the casing 1042 into the opening 1110 for purposes to be discussed hereinafter. The upper side 1118 also has a concave or curved edge 1122 (see FIGS. 12 and 13) partially defining the hole 1116.

Now referring to FIG. 13, the circuit unit 1056 includes a printed circuit board 1060, a speaker unit 1058, a preprogrammed chip 1062 and a power source 1064 (e.g., batteries). A switch 1074 is provided on the printed circuit board 1060 and includes an expanded contact area 1076 and a switch plate 1078 positioned on the printed circuit board 1060. Slots 1124 are also formed in an upper edge 1126 of the printed circuit board 1060 for purposes to be discussed hereinafter. The circuit unit 1056 is also provided with a "testing" switch 1128 adapted for use by a prospective buyer for testing the candleholder 1040. More particularly, when a button 1130 of the "testing" switch 1128 is depressed, the candleholder 1040 generates predetermined special effects (e.g., musical melodies) for a preset time period.

A cover 1132 (see FIG. 13) is removably or fixedly attached to the casing 1042 for closing off the opening 1110. The cover 1132 is equipped with a projection 1134, which has a concave or curved edge 1136. The projection 1134 is received in the hole 1116 of the casing 1042 for forming a substantially circular opening 1137 (see FIG. 12) defined by the concave edge 1122 of the casing 1042 and the concave edge 1136 of the cover 1132. An orifice 1138 is also formed in the cover 1132 such that the button 1130 of the "testing" switch 1128 can extend outwardly through the orifice 1138 for allowing a prospective buyer to test the candleholder 1040.

Figure 15:
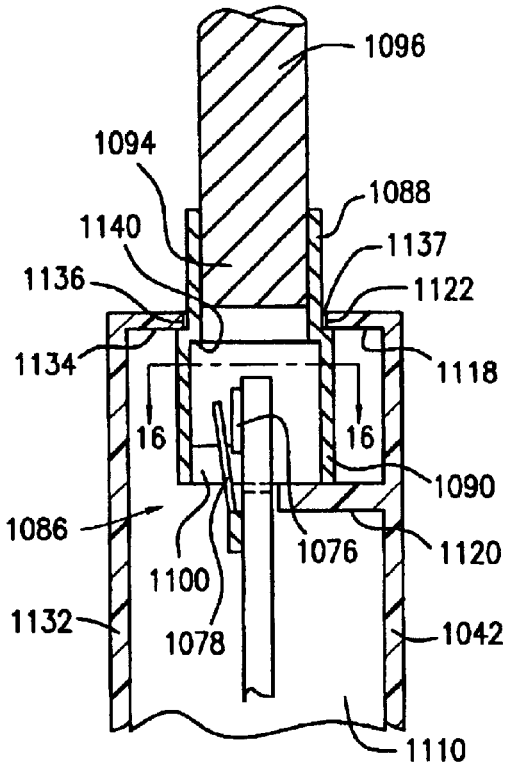
FIG. 15 is a cross-sectional view, taken along section line 15—15 and looking in the direction of the arrows, of the candle assembly shown in FIG. 12.

Referring to FIGS. 13–15, the candleholder 1040 also includes a ring 1086 rotatably mounted on the casing 1042 and having an upper section 1088 and a lower section 1090. An opening 1092 extends through the ring 1086 between the upper section 1088 and the lower section 1090. The upper section 1088 is sized and shaped so as to receive a bottom end 1094 of a candle 1096 such that the candle 1096 can be supported from the casing 1042. The lower section 1090 has an outer diameter greater than the outer diameter of the upper section 1088, thereby forming a shoulder 1140 at a junction between the upper and lower sections 1088, 1090. The ring 1086 is rotatably received in the hole 1116 (i.e., the opening 1137) of the casing 1042. More particularly, the upper section 1088 projects outwardly from the casing 1042 and is retained between the concave edge 1122 of the casing 1042 and the concave edge 1136 of the projection 1134 of the cover 1132 (see FIG. 15), while the lower section 1090 is positioned within the casing 1042 between the upper wall 1118 and the ledge 1120 of the casing 1042 (see FIG. 15). The lower section 1090 of the ring 1086 is also positioned in the slots 1124 of the printed circuit board 1060 for providing further support to the ring 1086 (see FIGS. 14 and 16). Because the shoulder 1140 has a diameter greater than the diameter of the opening 1137 formed by the concave edges 1122, 1136 of the casing 1042 and the cover 1132, respectively, the lower section 1090 is securely captured in the casing 1042, hence preventing the ring 1086 from being removed inadvertently from the casing 1042.

Figure 16:
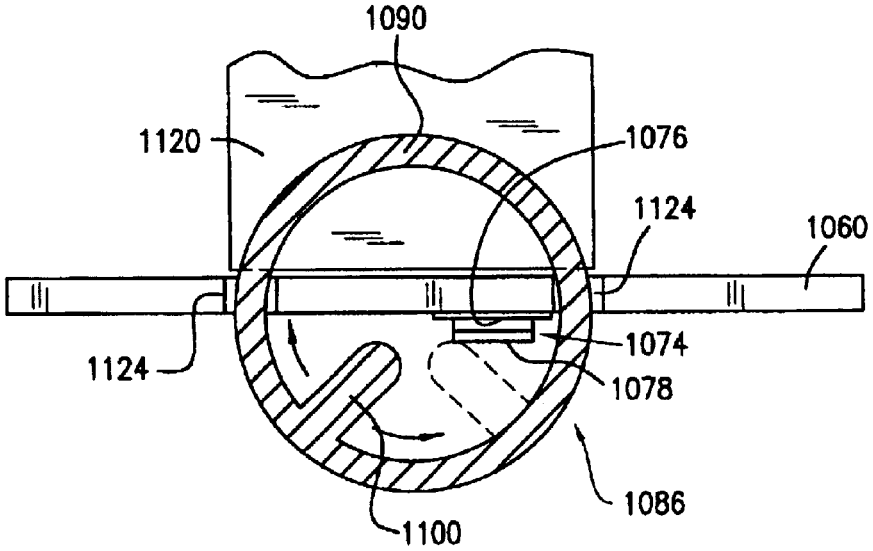
FIG. 16 is a cross-sectional view, taken along section line 16—16 and looking in the direction of the arrows, of the candle assembly shown in FIG. 15.

With reference to FIGS. 15 and 16, the ring 1086 includes a finger 1100 projecting radially inwardly from the lower section 1090. The finger 1100 is adapted for urging the switch plate 1078 of the switch 1074 against the contact area 1076 when the ring 1086 is rotated from its "off" position to its "on" position (see FIG. 16).

It should be noted that the candleholder 1040 can have numerous variations and modifications. For instance, the slots 1124 formed in the printed circuit board 1060 can be replaced with other suitable mechanisms. The ledge 1120 can also be eliminated or replaced with other support members. In addition, the casing 1042 can be provided with different shapes and sizes.

It will be understood that the embodiments described herein are merely exemplary and that a person skilled in the art may make many variations and modifications without departing from the spirit and scope of the invention. All such variations and modifications, including those discussed above, are intended to be included within the scope of the invention as defined by the appended claims.

I claim:

1. A device for supporting a candle thereon, comprising a casing having an opening therein, an end and a slot which is formed in said casing adjacent said end; generating means for generating special effects, said generating means including a switch mounted in said opening, said switch including a first contact member, which is substantially immovable relative to said casing, and a second contact member, said second contact member being movable relative to said first contact member between a first position, in which said second contact member is in contact with said first contact member, and a second position, in which said second contact member is out of contact with said first contact member, said generating means generating special effects when said second contact member is in one of its said first and second positions; and a ring movably mounted on said casing and having an extension which projects inwardly into said opening of said casing through said slot for engaging said second contact member of said switch so as to move said second contact member between its said first and second positions.

2. The device of claim 1, wherein said generating means includes a printed circuit board positioned within said opening of said casing and having a printed circuit thereon.

3. The device of claim 2, wherein said first and second contact members are mounted on said printed circuit board.

4. The device of claim 3, wherein said first contact member is immovably positioned on said printed circuit board.

5. The device of claim 4, wherein said first contact member is formed on said printed circuit board as part of said printed circuit.

6. The device of claim 5, wherein said second contact member includes first and second ends, said first end of said second contact member being fixedly attached to said printed circuit board, said second contact member projecting outwardly away from said printed circuit board when said second contact member is positioned in its said second position such that said second end of said second contact member is out of contact with said first contact member.

7. The device of claim 6, wherein said printed circuit board includes a hole therein, said hole receiving said first end of said second contact member for mounting said second contact member to said printed circuit board.

8. The device of claim 1, wherein said generating means produces audible sounds when said second contact member is in said one of its said first and second positions.

9. The device of claim 8, wherein said generating means produces visible lights when said second contact member is in said one of its said first and second positions.

10. The device of claim 1, wherein said slot extends in a direction substantially transverse to a longitudinal axis of said casing, said extension being movable in said slot.

11. The device of claim 10, wherein said casing includes a groove extending in a direction substantially parallel to said longitudinal axis of said casing, said groove extending from said end of said casing and terminating at said slot, said groove being sized and shaped so as to receive said extension of said movable member for positioning said extension in said slot through said groove.

12. The device of claim 11, wherein said ring is rotatably mounted on said end of said casing, said ring including supporting means for supporting a candle thereon.

13. The device of claim 11, wherein said ring is mounted on said casing such that said end of said casing extends beyond said ring, said end being sized and shaped for supporting a candle thereon.

14. A device for supporting a candle thereon, comprising a casing having an opening therein, a pair of opposing ends and a slot which is formed in said casing adjacent one of said ends; generating means for generating special effects, said generating means including a switch mounted in said opening, said switch including a first contact member, which is substantially immovable relative to said casing, and a second contact member, said second contact member being movable relative to said first contact member between a first position, in which said second contact member is in contact with said first contact member, and a second position, in which said second contact member is out of contact with said first contact member, said generating means generating special effects when said second contact member is in one of its said first and second positions; and a ring movably mounted on said casino for moving said second contact member between its said first and second positions and having an extension which projects inwardly into said opening of said casing through said slot for engaging said second contact member, said ring being rotatable between a third position, in which said extension is in engagement with said second contact member so as to position said second contact member in its said first position, and a fourth position, in which said extension is out of engagement with said second contact member so as to position said second contact member in its said second position.

15. The device of claim 14, wherein said slot extends in a direction substantially transverse to a longitudinal axis of said casing, said extension being movable in said slot.

16. The device of claim 15, wherein said casing includes a groove extending in a direction substantially parallel to said longitudinal axis of said casing, said groove extending from said one of said ends of said casing and terminating at said slot, said groove being sized and shaped so as to receive said extension of said movable member for positioning said extension in said slot through said groove.

17. The device of claim 16, wherein said ring is rotatably mounted on said one of said ends of said casing, said ring including supporting means for supporting a candle thereon.

18. The device of claim 16, wherein said ring is mounted on said casing such that said one of said ends of said casing extends beyond said ring, said one of said ends being sized and shaped for supporting a candle thereon.

19. A device for supporting a candle thereon, comprising a casing having an opening therein and a side which includes a hole; generating means for generating special effects said generating means, including a switch mounted in said opening, said switch including a first contact member, which is substantially immovable relative to said casing, and a second contact member, said second contact member being movable relative to said first contact member between a first position, in which said second contact member is in contact with said first contact member, and a second position, in which said second contact member is out of contact with said first contact member, said generating means generating special effects when said second contact member is in one of its said first and second positions, said generating means including a printed circuit board positioned within said opening of said casing and having a printed circuit thereon, said printed circuit board having an edge which is positioned adjacent said side of said casing; and a ring movably mounted on said casing for moving said second contact member between its said first and second positions, said ring including an extension projecting inwardly into said opening of said casing for engaging said second contact member, said ring being rotatable between a third position, in which said extension is in engagement with said second contact member so as to position said second contact member in its said first position, and a fourth position, in which said extension is out of engagement with said second contact member so as to position said second contact member in its said second position, said ring having lower and upper sections, said ring being received in said hole of said casing such that said lower section is positioned in said casing and the upper section projects outwardly from said casing for supporting a candle therefrom, said lower section of said ring resting on said edge of said printed circuit board.

20. The device of claim 19, wherein said printed circuit board includes a pair of slots formed in said edge, said lower section being received in said slots.

21. The device of claim 20, wherein said casing has a ledge projecting inwardly from said casing into said opening, said ledge cooperating with said edge of said printed circuit board so as to support said lower section of said ring.

22. A device for supporting a candle thereon, comprising a casing having an opening therein and a side; generating means for generating special effects, said generating means including a switch mounted in said opening, said switch including a first contact member, which is substantially immovable relative to said casing, and a second contact member, said second contact member being movable relative to said first contact member between a first position, in which said second contact member is in contact with said first contact member, and a second position, in which said second contact member is out of contact with said first contact member, said generating means generating special effects when said second contact member is in one of its said first and second positions, said generating means including a printed circuit board positioned within said opening of said casing and a printed circuit thereon, said printed circuit board having an edge which is positioned adjacent said side of said casing; and a ring movably mounted on said casing for moving said second contact member between its said first and second positions, said ring resting on said edge of said printed circuit board.

23. The device of claim 22, wherein said ring is rotatably mounted on said casing and includes an extension projecting inwardly into said opening of said casing for engaging said second contact member.

24. The device of claim 23, wherein said ring is rotatable between a third position, in which said extension is in engagement with said second contact member so as to position said second contact member in its said first position, and a fourth position, in which said extension is out of engagement with said second contact member so as to position said second contact member in its said second position.

25. The device of claim 22, wherein said side includes a hole, said ring having lower and upper sections, said ring being received in said hole such that said lower section is positioned in said casing and resting on said edge of said printed circuit board and said upper section projects outwardly from said casing for supporting a candle therefrom.

26. The device of claim 22, wherein said printed circuit board includes a pair of slots formed in said edge, said ring having a lower section received in said slots.

27. The device of claim 26, wherein said casing has a ledge projecting inwardly from said casing into said opening, said ledge cooperating with said edge of said printed circuit board so as to support said lower section of said ring.

* * * * *